US008529733B2

(12) United States Patent
Wildfong et al.

(10) Patent No.: US 8,529,733 B2
(45) **Date of Patent: *Sep. 10, 2013**

(54) TWIN FABRIC FORMING SECTION WITH MULTIPLE DRAINAGE SHOES

(75) Inventors: Vaughn Wildfong, East Longmeadow, MA (US); Jay Shands, Belchertown, MA (US); James Ronning, South Hadley, MA (US); Josh Price, Morrisonville, NY (US)

(73) Assignee: AstenJohnson, Inc., Charleston, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/125,398

(22) PCT Filed: Oct. 21, 2009

(86) PCT No.: PCT/US2009/061398

§ 371 (c)(1), (2), (4) Date: Aug. 16, 2011

(87) PCT Pub. No.: WO2010/048240

PCT Pub. Date: Apr. 29, 2010

(65) Prior Publication Data

US 2011/0290442 A1 Dec. 1, 2011

Related U.S. Application Data

(60) Provisional application No. 61/107,051, filed on Oct. 21, 2008.

(51) Int. Cl.
*D21F 1/06* (2006.01)

(52) U.S. Cl.
USPC ..... 162/344

(58) Field of Classification Search
USPC ..... 162/344, 300–303, 212, 351, 352, 162/203, 271
See application file for complete search history.

(56) References Cited

U.S. PATENT DOCUMENTS

| | | | | |
|---|---|---|---|---|
| 4,648,943 | A * | 3/1987 | Malashenko et al. | 162/300 |
| 5,084,138 | A | 1/1992 | Ewald | |
| 5,635,032 | A * | 6/1997 | Bubik et al. | 162/301 |
| 6,372,091 | B2 | 4/2002 | Wildfong et al. | |
| 6,881,302 | B2 | 4/2005 | Masuda et al. | |
| 7,005,040 | B2 | 2/2006 | Buchanan et al. | |
| 7,364,643 | B2 | 4/2008 | Poikolainen et al. | |
| 7,491,295 | B2 | 2/2009 | Poikolainen et al. | |
| 7,524,401 | B2 | 4/2009 | Wildfong et al. | |

(Continued)

FOREIGN PATENT DOCUMENTS

EP 1315861 11/2006

*Primary Examiner* — Mark Halpern
(74) *Attorney, Agent, or Firm* — Volpe and Koenig, P.C.

(57) ABSTRACT

A forming section for a twin fabric papermaking machine, wherein after stock impingement, the two fabrics carry and sandwich the stock. A plurality of spaced apart drainage shoes, selectively provided to either or both of the fabrics, provides continuous support in the machine direction for the respective fabric in sliding contact, and each drainage shoe deflects the fabrics by a selected angle of wrap comprising an angular displacement between the leading edge and the trailing edge of the drainage shoe. At least one of the drainage shoes is secured to a drainage box and is provided with a plurality of drainage openings extending from the fabric contacting surface through to the machine side surface of the shoe. The arrangements of the invention provide improved drainage and formation of the paper web.

36 Claims, 7 Drawing Sheets

(56) References Cited

U.S. PATENT DOCUMENTS

| | | | | |
|---|---|---|---|---|
| 7,524,402 | B2 | 4/2009 | Wildfong et al. | |
| 7,776,183 | B2 * | 8/2010 | Wildfong et al. | 162/301 |
| 2005/0006044 | A1 | 1/2005 | Muhonen et al. | |
| 2007/0295468 | A1 | 12/2007 | Wildfong et al. | |

* cited by examiner

TWIN FABRIC FORMING SECTION WITH MULTIPLE DRAINAGE SHOES

This application is a 371 of PCT/US09/61398 filed 21 Oct. 2009.

CROSS-REFERENCE TO RELATED APPLICATIONS

This application claims priority from Application 61/107,051 and PCT/US2009/061398, the contents of which are hereby incorporated by reference herein.

FIELD OF THE INVENTION

The invention relates to the forming section of a twin fabric papermaking machine, and in particular to an arrangement of two or more drainage shoes in the initial part of the forming section, and most particularly to arrangements of multiple drainage shoes to provide improved drainage and formation of the web.

BACKGROUND

The invention concerns an arrangement of selected ones of the drainage and formation elements in the initial part of the forming section of a twin fabric papermaking machine to optimize drainage and retention properties in a paper product. It particularly concerns the use of two or more drainage shoes, located in series and in sliding contact with either or both the backing and/or conveying fabric, so as to adjust the angle of wrap of the two fabrics and thereby optimize the drainage, retention and formation properties of the web. The drainage shoes are structured and arranged to provide improved control of web drainage rates and sheet formation during the manufacture of cellulosic products of varying basis weights and can provide for wrap angles of the fabrics and drainage velocities previously difficult or impossible to achieve in prior art arrangements.

As used herein, the term "drainage shoe" specifically relates to a fabric support apparatus which provides continuous machine direction (MD) oriented support for the fabrics and web with or without flow through drainage of fluid removed from the web. These drainage shoes should be distinguished from conventional "forming shoes" which comprise multiple blades, each extending across the width of the forming section (i.e. in the cross-machine direction (CD)), and each being spaced apart in the MD from consecutive blades in the shoe. The drainage shoes employed in the forming section of the present invention provide continuous MD support for the papermaking fabrics with which they have contact; the shoes may be provided with either MD oriented slots through which drainage can occur, or a plurality of holes or similar openings and between which are land areas which serve to provide the MD support for the fabrics. Alternatively, the drainage shoes of the invention may be solid and closed to flow-through drainage. The drainage shoes will serve to deflect the fabrics and stock through an angle of wrap sufficient to effect the desired level of formation and drainage.

In a twin fabric forming section of a modern papermaking machine, the papermaking stock is delivered at high speed and precision from the headbox slice lips into a gap between two converging forming fabrics. The fabrics are typically arranged so that the stock jet impinges onto a first fabric as it passes in sliding contact over either a curved, bladed forming shoe (as in blade forming) or a suction forming roll (as in roll forming) with the second fabric constraining the stock between the fabrics over the shoe or roll. One of these fabrics will be arranged as a conveying fabric which will transfer the sheet to the press section downstream of the forming section, while the second fabric will be located as a backing fabric to retain the stock sandwiched between the fabrics. Both roll and blade forming processes offer various advantages, but each suffers from corresponding disadvantages which the present invention seeks to address.

In blade forming arrangements, the two fabrics together with the stock wrap a series of cross-machine direction (CD) oriented blades which are precisely located on a curved forming shoe. The stock jet from the headbox impinges onto a first fabric (either the conveying or backing fabric) prior to the first blade; the angles at which the fabrics converge are generally small, in the range of from about 3° to 4°, making the products formed in a blade forming arrangement highly sensitive to jet impingement angles and thus sheet defects. Fabric tensions and deflection over the blades provide pulsating pressure and shear to the stock while driving the initial dewatering. Some current blade former designs are drainage limited, meaning that they do not drain the stock sufficiently in the early stage of formation. Blade forming typically produces paper products exhibiting good formation due to the multiple successive periodic pressure pulses and shear introduced into the stock by the CD-oriented blades. However, these successive pressure pulses can disturb fine material already deposited into the initial mat which will be lost from the sheet but may subsequently be recirculated with the filtrate as drainage occurs. Thus, blade formers generally offer good formation but at the cost of poor first pass retention and drainage.

In roll forming arrangements, the two fabrics together with the stock wrap a portion of a rotating suction forming roll and the deflection of the fabrics over the roll provides for a more constant and sustained initial drainage. Roll forming typically provides for better retention of fines due to the absence of multiple successive pressure pulses as are found in blade forming arrangements, but offers less satisfactory formation and usually a higher operational cost because of the energy consumption of the suction roll. Roll forming is less sensitive to changes in the jet impingement angle than blade forming due to the larger fabric convergence angles, which are generally from about 8° to 10°.

It is well known that the radius of the forming roll has a direct effect on the drainage velocity, or the rate at which water is removed from the embryonic paper web. A drainage roll with a large amount of fabric wrap is frequently required so as to provide sufficient drainage for heavier basis weight products such as corrugating medium, linerboard and the like. Suction forming rolls are very expensive and, once installed, cannot be easily moved or changed; maintenance costs are also high. The forming roll also occupies a large amount of space at the early part of the forming section near the point of impingement. During operation, drained fluid is expressed outwardly over the wrapped portion of the roll and into the cavities of the roll shell. As the fabrics leave the forming roll, roll side drainage is expressed out of the roll. Paper products produced in a roll forming process can exhibit fabric separation defects upon exit from the roll due to the vacuum pulse created at the diverging nip between the roll and fabric at the end of the roll wrap; this vacuum can pull the two fabrics apart, creating a defect in the paper product. In addition, as the drainage is expressed at atmospheric conditions into the fabric loop, the vacuum seal of the suction roll is lost at the exit nip and has to be continuously regenerated at the expense of higher energy requirements. Further, undesirable misting can develop with this drainage, causing rewetting or defects in the sheet. Roll formers thus offer improved retention characteristics and reduced initial impingement sensitivity in comparison to blade formers, while sacrificing formation at higher operating costs and presenting other operational issues.

Relatively heavy basis weight grades of paper products, such as corrugating, linerboard and the like, as well as lighter weight paper products intended for newsprint, magazine and advertising type publications which include a large amount of filler materials (e.g. calcium carbonate, talc, various clays and the like) require rapid initial drainage in a manner that does not introduce multiple successive pressure pulses. Production of these grades can be optimized if they can be drained quickly while providing good formation properties and high first pass retention (low loss of fillers). In the past, these grades were often manufactured using roll former configurations.

U.S. Pat. No. 7,005,040 (Buchanan et al.) discloses improved drainage of fluid and removal of entrained air from the stock jet by locating, at the point of impingement in a single or twin fabric forming section, a grooved impingement shoe including MD oriented, profiled fabric support surfaces between which flow-through vents are located. The impingement shoe is comprised of a plurality of at least first and second thin laminar segments which are shaped so as to provide a desired surface profile over which the forming fabrics slide, and between which are located the flow-through vents for the removal of entrained air and water.

EP 1315861 (Buchanan et al.) discloses a vented lead blade located in a single or twin fabric papermaking machine such that the stock jet impinges the forming fabric at or near its trailing edge. The blade serves to bend the forming fabric before it enters the forming section, and to vent a substantial proportion of any air and at least some liquid through MD oriented slots located between the support surfaces.

US 2007/0295468 (Wildfong et al.) discloses an adjustable impingement shoe which can be moved, either by pivoting or transverse movement, so that the position of the point of impingement of the jet of papermaking stock can be adjusted to optimize formation.

U.S. Pat. No. 7,491,295 (Poikolainen et al.) discloses a dewatering element for use in the forming section which element includes a non-pulsating suction zone formed of drilled holes; this zone is followed by a CD-oriented outlet groove which provides pulsation to the stock.

U.S. Pat. No. 7,364,643 (Poikolainen et al.) discloses a twin fabric forming arrangement having two successive dewatering zones. In the first zone, one of the two fabrics is supported in sliding contact as it passes over the curved surface of a fixed forming shoe while the other fabric is unsupported. The second dewatering zone is formed by fixed blades mounted downstream from and on the opposite side to the forming shoe, between which are located resiliently mounted CD oriented blades which together cause a pulsed dewatering to occur.

U.S. Pat. No. 6,881,302 (Masuda et al.) discloses a forming arrangement including a plurality of convexly curved forming shoes each equipped with generally MD oriented grooves which foil and direct fluid from the underside of the fabric and web away from the shoe surface.

U.S. Pat. No. 6,372,091 (Wildfong et al.) discloses a twin fabric forming section including at least one forming shoe. The paper side surface of the shoe includes a multiplicity of grooves which do not extend to the leading edge, and do not extend through the shoe.

As used herein, the following terms have the following meanings ascribed to them:

Angle of wrap: the angular displacement between the leading and trailing edges of the shoe as measured by the change in orientation of a line tangent to the shoe surface at the leading edge to that of a line tangent to the shoe surface at the trailing edge. The angle of wrap is identified without a directional value, so that in the forming sections of this invention, the two or more drainage shoes are arranged to provide to the fabrics a total angle of wrap, which is the sum of the positive values of the angles of wrap over each of the drainage shoes.

Pressure pulse: a change in fluid pressure in the stock as the fabric on which it is carried passes over an external element.

Radius of curvature: the straight line distance to the centre of an imaginary circle whose curvature corresponds to that of a portion of the surface of a drainage shoe Fabric contacting surface: the surface of the portion of a fabric supporting element over which a moving fabric passes in sliding contact.

Machine direction (MD): a direction parallel to the direction of travel of the paper product as it passes through the paper machine from the headbox through the dryer section.

Cross-machine direction (CD): a direction transverse to but in the plane of the MD.

The prior art forming section arrangements noted above have all met with varying degrees of success, but none of these solutions on its own is able to combine the desirable aspects of roll forming, namely good first pass retention and relative insensitivity to jet impingement position, with the beneficial pressure pulse activity and initial drainage characteristics of blade forming. Thus, it would be highly desirable if a smaller device or devices were available to replace the suction forming roll, which device or devices was less expensive to purchase and install, and which allowed for either or both:

(a) variation of the angle of wrap of the forming fabrics in accordance with changes in the characteristics of the stock and product to be produced, and (b) a large angle of wrap of the forming fabrics without the associated manufacturing costs of a suction forming roll. In particular, it would be even more advantageous if such device could provide a large drainage capacity, i.e. the ability to handle large volumes of fluid to effect drainage of the web, and at the same time be non-pulsating, i.e. not introducing disruptive pressure pulses into the stock, which reduce filler and fines retention in the paper product. It would be further beneficial if a plurality of such devices could be arranged within the forming section so as to provide the aforementioned benefits to a wide range of paper products at a relatively low cost.

The present invention seeks to address these aforementioned deficiencies of the prior art by providing, in the initial forming zone of a twin fabric papermaking machine, an arrangement of at least two drainage shoes which are constructed and arranged so as to optimize both drainage and formation of the web without reducing retention or introducing sheet defects. The arrangement of the drainage shoes in the forming section of this invention does not restrict the angle of wrap of the fabrics as they move in sliding contact over the devices as has been previously required in either roll or blade type forming arrangements. By means of this invention, the angle of wrap experienced by the forming fabrics, over each individual drainage shoe and as a total angle of wrap over all the drainage shoes in combination, can be carefully selected for the specific circumstances, i.e. it can be made as large or as small as necessary to provide the required drainage and formation to optimize web properties.

It has now been found that important advantageous aspects of both roll and blade forming can be combined so as to optimize paper formation, particularly for heavier basis weight grades, but applicable to all basis weight grades. The forming section arrangements of the present invention reduce the sensitivity of the paper product to jet impingement angle (as in roll forming) while offering excellent formation properties by providing sustained, but changing, machine direction pressure during early formation. Because the pressure is sustained instead of pulsating, fines retention values are typically improved.

A further benefit provided by this invention is that the sustained pressure experienced by the stock as the forming fabrics wrap over multiple shoes is caused to vary in the MD with the changing radius of curvature of the fabric contact surface of each shoe. This creates a non-pulsating MD shear in the stock, thereby breaking up any fiber flocs while providing good retention and better formation than would be available in a comparable roll former of the same drainage capacity and total fabric wrap. It is also within the scope of the invention that the fabric contact surface profile of one drainage shoe may differ from any of the other shoes in the forming section, and the surface profile of each need not be constant, but may vary continuously in the MD according to need. It thus follows that the MD profile of the fabric contact surfaces of successive downstream drainage shoes can be the same as, or different from, that of the initial shoe upon which the stock jet impinges.

A further advantage of the novel construction and arrangement of the drainage shoes in the forming section of this invention is the elimination of fabric separation defects. In the past, in roll forming, it was often necessary to exceed the design angle of wrap so as to "dry up" the sheet prior to roll exit. Sheet separation defects in the forming section were caused by the fabrics leaving a rotating roll such as a suction forming roll at low sheet consistency. The vacuum pulse created at the diverging nip between the roll and fabric at the end of the roll wrap could pull the two fabrics apart, damaging the paper product. In the forming section arrangement of the present invention, the geometry or arrangement of the components that previously existed and which caused this sheet separation defect no longer exist. Further, the surface profile of each of the drainage shoes, as well as the amount of fabric wrap over each shoe necessary to obtain optimum papermaking conditions, can be chosen without risking the possibility of fabric separation defects. This is important, because the amount of fabric wrap on a sustained pressure element such as a shoe or roll has a significant effect on formation. Relatively larger angles of wrap on such elements typically resulted in poorer formation, while smaller angles of wrap would provide better formation. Certain paper grades, such as heavier basis weight papers, require a relatively large amount of non-pulsating drainage (i.e. large angles of wrap) to adequately dewater the sheet.

A further limitation of the prior art forming section arrangements such as those previously described is that larger shoes are more difficult and expensive to manufacture. According to the teachings of the present invention, it is now possible to arrange multiple, relatively smaller drainage shoes in succession on either one or both sides of the fabrics to provide better water handling control and drainage symmetry. The use of multiple shoes will provide greater flexibility in forming section design, especially where space constraints exist.

SUMMARY

The present invention seeks to provide a forming section for a twin fabric papermaking machine, the forming section constructed and arranged to receive a pair of forming fabrics comprising a first fabric and a second fabric, each supported by a plurality of rolls and support elements, the forming section comprising:

(i) a headbox having a headbox slice, wherein in operation (a) the headbox delivers a jet of stock through the headbox slice onto the first fabric at a point of impingement;

(b) the first fabric passes over a first support element upstream of the point of impingement, and carries the stock as a layer after the point of impingement; and (c) the second fabric passes over and is guided by a second support element into contact with the stock layer proximate the point of impingement and thereafter cooperates with the first fabric to sandwich the stock layer; and (ii) a plurality of drainage shoes, comprising at least (a) a first drainage shoe located to support a selected one of the first and second fabrics in sliding contact;

(b) at least a second drainage shoe downstream of and spaced apart from the first drainage shoe over which a selected one of the forming fabrics passes in sliding contact, wherein (1) each drainage shoe has (A) a leading edge and a trailing edge;

(B) a fabric contacting surface extending to the trailing edge and having predetermined machine direction and cross-machine direction profiles and constructed and arranged to contact and provide continuous support in the machine direction to a selected one of the forming fabrics and to deflect both the first and the second fabrics and the stock therebetween by a selected angle of wrap comprising an angular displacement between the leading edge and the trailing edge of the drainage shoe, said angular displacement being measured by a change in orientation of a line tangent to the fabric contacting surface at the leading edge in relation to a line tangent to the fabric contacting surface at the trailing edge; and (C) a machine side surface; and (2) at least one of the drainage shoes is secured to a drainage box and is provided with a plurality of drainage openings which extend from the fabric contacting surface through to the machine side surface of the shoe.

The angle of wrap can be any appropriate angle for the machine conditions, but for each drainage shoe is preferably between 10° and 50°, more preferably between 15° and 35°, and for some conditions between 15° and 25°.

Preferably, in many applications, the first shoe is relatively flatter than the subsequent shoes, and will have a smaller angle of wrap than the remaining shoe or shoes located downstream of this first shoe. Preferably, the angle of wrap formed by the first upstream drainage shoe will be from about 5° to about 45°. More preferably, the angle of wrap of the first drainage shoe will be between 10° and 35°.

Preferably, the total angle of wrap formed by the fabrics as they pass over all of the drainage shoes in the forming section is between 10° and 100°. More preferably, the total angle of wrap is between 30° and 70° with each drainage shoe contributing a minimum of 5° wrap (typically in the first shoe) to as much as 50°. Preferably, the drainage shoes are arranged so that each contributes from about 15° to about 35° wrap of the fabrics.

According to the invention, the drainage shoes can be mounted in a manner selected according to the intended end use, for example on a gravity drainage box, or a suction device. As the fabric contacting surface of the shoe includes at least a solid leading and trailing surface (i.e. one that does not provide suction accessible openings either to the ambient atmosphere or into the suction device) suction can be maintained within a drainage device upon which a shoe is mounted, and the solid leading and trailing edges facilitate skimming off air and water entrained with the fabric.

Preferably, the fabric contact surface of each shoe, in between its leading and trailing edges, is structured and arranged to provide continuous MD support for one of the forming fabrics so as to create a continuous sustained pressure or shear within the stock sandwiched between the fabrics.

Preferably, the fabric contact surface of a drainage shoe will provide an open area of from 70-0% of the total fabric contact surface exclusive of the solid leading and trailing edges of the drainage shoe. Preferably, the open area of the fabric contact surface of a drainage shoe will be from about 40% to 60% exclusive of the leading and trailing edge areas of the shoe.

The open area of the shoe surface is preferably provided by suction accessible slots or vents in the manner described by Buchanan et al. in U.S. Pat. No. 7,005,040; these MD oriented slots and fabric support surfaces will provide continuous and variable, but non-pulsating, MD pressure to the stock as the fabrics pass over the drainage shoe surface. However, a drainage shoe whose surface is drilled or which is provided with similar openings into the drainage device below, in the manner described for example by Wildfong et al. in U.S. Pat. No. 6,372,091 may prove equally effective. The shoe surfaces disclosed by Buchanan et al. and the drilled shoe surfaces described by Wildfong et al. will provide the necessary continuous MD support for the fabrics.

It is important to note that the drainage shoes utilized in the forming section of the invention do not include CD oriented openings (as are present in forming shoes) which would cause intermittent pressure pulses in the stock sandwiched between the fabrics.

In an alternate embodiment of the invention, one or more of the shoes in the forming section arrangement may be completely solid and without openings into either the atmosphere or to a drainage device. It is within the scope of the present invention that at least one shoe can be equipped with a surface having 0% open area, i.e. which is solid from its leading to its trailing edge.

The MD profile of the fabric contacting surface of each of the drainage shoes employed in the forming section of the present invention may be simple, where the shape of the surface can be described using a single radius of curvature (i.e. the surface is curved smoothly in the shape of an arc), or complex, and having a plurality of radii of curvature. Preferably, the fabric contacting surface profiles of each of the drainage shoes in the forming section will differ one from another, with each successive shoe ending with a smaller radius of curvature than in the immediately preceding shoe.

The MD size of the drainage shoe used in the forming sections of this invention can be selected according to the intended end use, and will generally range from about 6 inches (15.24 cm) up to about 48 inches (121.92 cm) in the length or MD direction, but will preferably have a length that is less, generally in the range of 6-24 inches (15.24-60.96 cm). The drainage shoes are provided with a solid leading edge (i.e. one that is not open to provide through drainage) that is from about ½ inch (about 1 cm) in MD length up to about 2 inches (about 5 cm), and a solid trailing edge at the downstream side of about the same size. As noted above, at least one of the drainage shoes will preferably be constructed in the manner described by Buchanan et al. in U.S. Pat. No. 7,005,040 or alternatively the drilled drainage shoes as described by Wildfong et al. in U.S. Pat. No. 6,372,091 so as to provide the desired surface profile and open area intermediate of the leading and trailing surfaces.

The selection of particular configurations or features will depend primarily on the type of stock being used in the papermaking process, the prevailing conditions in the papermaking machine, and the intended end use of the sheet being formed. As papermaking machine speeds increase in order to manufacture paper products more economically, factors such as the runnability of the machine, the appearance and internal structure of the sheet, the distribution of fines and fillers in the surface or interior of the product, and the first pass retention of fine material become increasingly important. It is also desirable that substantially constant rates of drainage be maintained at different locations along the path of travel of the paper product through the forming section, for good combination of first pass retention of fine material and sheet formation. By appropriate selection of the order and arrangement of the drainage shoes, it is now possible to provide simultaneous control over many, if not all, of these variables.

The second drainage shoe can be provided to a second of the two fabrics, or two or more drainage shoes can be provided in adjacent sequence to a first of the two fabrics, which can optionally be followed by at least one drainage shoe provided to the second fabric, i.e. downstream of the plurality of drainage shoes provided to the first fabric. Thus, there can be as many drainage shoes as may be required for the specific conditions, up to at least four or more.

The relative placement of the at least two drainage shoes in the forming section of this invention is important, while in each case providing the required total angle of wrap for the fabrics. When the at least two shoes are located on the same side of the forming section and in contact with the same fabric, the MD distance between the successive shoes can be in the range of from 1 to 12 inches (25-300 mm). However, when two of the drainage shoes are located in succession one following the other and on opposite sides of the fabrics from one another, there should be at least 2 inches (50 mm) between the trailing edge of one shoe and the leading edge of the next shoe in the MD, and they can be separated by as much as 18 inches (457 mm) or more. In addition, doctoring edges can be provided as required to the leading edges of any of the drainage shoes.

The drainage shoes can be secured to drainage boxes as appropriate for the conditions, such as those discussed above. For example, each member of at least one pair of adjacent drainage shoes provided to the conveying fabric can be secured to a common drainage box, or they can be mounted on separate drainage boxes, depending on whether any separate adjustment of the shoes may be required in relation to the orientation of the other shoes.

At least one, or all, of the drainage shoes can be secured to an adjustable drainage box, i.e. which can be adjusted into and secured in a desired position by translation or pivoting, in the manner described in US 2007/0295468 to Wildfong et al.

Preferably, the first support element comprises a breast roll, but alternatively, it can comprise at least one turning bar. Similarly, preferably the second support element comprises a forming roll, but alternatively it can comprise at least one turning bar.

The support elements provided upstream or downstream of the drainage shoes can be selected in each case from known elements according to the machine conditions, as noted above. Preferably the forming section further comprises, after and spaced apart from the trailing edge of the last drainage shoe, at least one forming shoe comprising a plurality of fabric support elements. The forming shoes can be provided with the usual features, including deflector blades at the leading edge.

Preferably, the forming section further comprises at least one counterblade unit provided to the first fabric substantially opposite to a first of the at least one forming shoe provided to the second fabric. Optionally, in the manner described in U.S. Pat. Nos. 7,524,401 and 7,524,402, each to Wildfong et al., adjacent ones of the plurality of fabric support elements in at least the first of the at least one forming shoe are spaced apart from each other by a decreasing distance in the machine direction. Further optionally, adjacent ones of the plurality of fabric support elements in at least the first of the at least one forming shoe have a decreasing width in the machine direction.

The forming section can further include a couch roll downstream from the trailing edge of the last drainage shoe or the trailing edge of the last forming shoe. Optionally, the couch roll is a suction roll comprising at least one vacuum zone.

The forming section can include a single ply headbox, or a multi-ply headbox.

BRIEF DESCRIPTION OF THE DRAWINGS

The invention will now be described in relation to the drawings, in which.

DETAILED DESCRIPTION OF THE PREFERRED EMBODIMENTS

Figure 7:
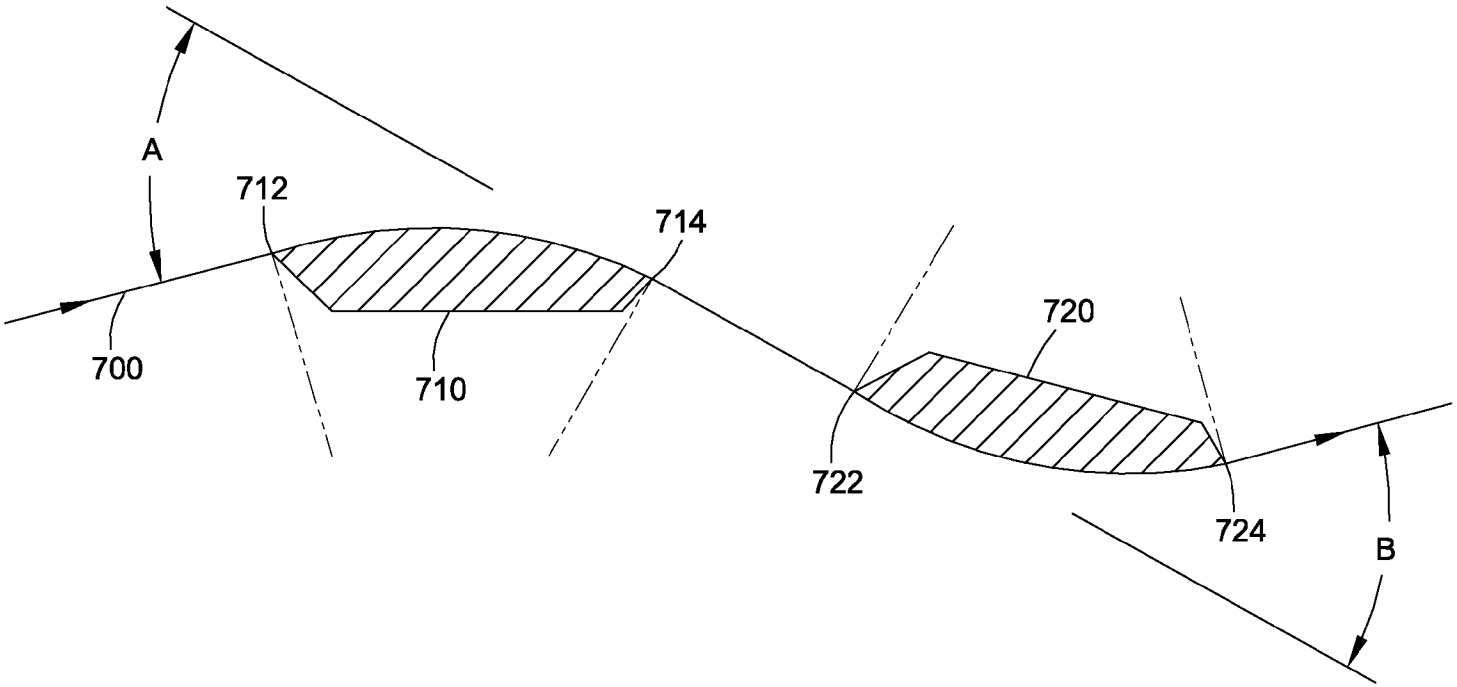
FIG. 7 is a schematic illustration of the angle of wrap for the drainage shoes in embodiments of the invention.

Referring first to FIG. 7, the feature of angle of wrap is identified, in relation to a fabric 700, shown as passing in sequence over, and being deflected by, two drainage shoes, 710, 720. As the fabric 700 passes over drainage shoe 710, the curvature of the fabric supporting surface of that drainage shoe between its leading edge 712 and its trailing edge 714 imparts an angular displacement to the fabric 700. This deflection, known as angle of wrap, is measured as angle A, being the angle between tangents to the drainage shoe 700 at leading edge 712 and trailing edge 714. Similarly, the angle of wrap for drainage shoe 720 is measured as angle B, being the angle between tangents to the drainage shoe 720 at its respective leading edge 722 and trailing edge 724. For the configuration shown in FIG. 7, the total angle of wrap imparted by the two drainage shoes 710, 720 is the sum of the positive values of angles A and B.

Figure 1:
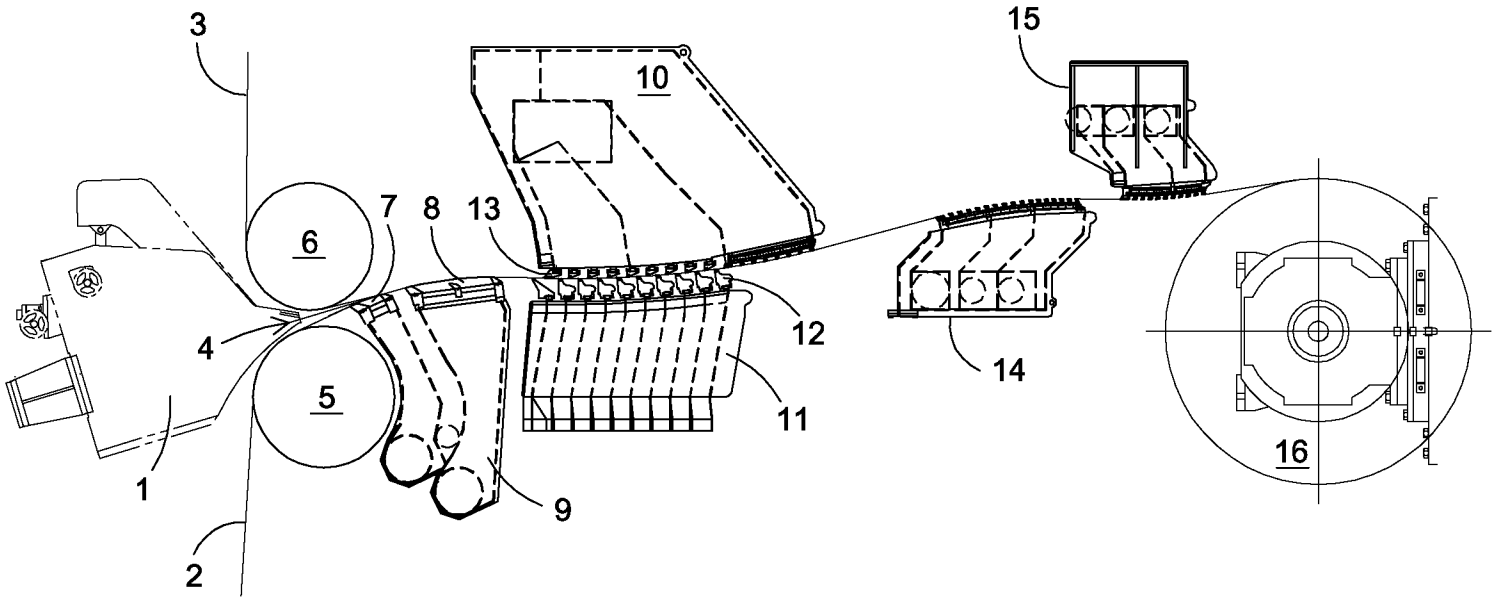
FIG. 1 is a schematic view of a forming section according to the invention including two drainage shoes located beneath a first fabric which may be the conveying fabric and mounted on a common, partitioned drainage box.
Figure 2:
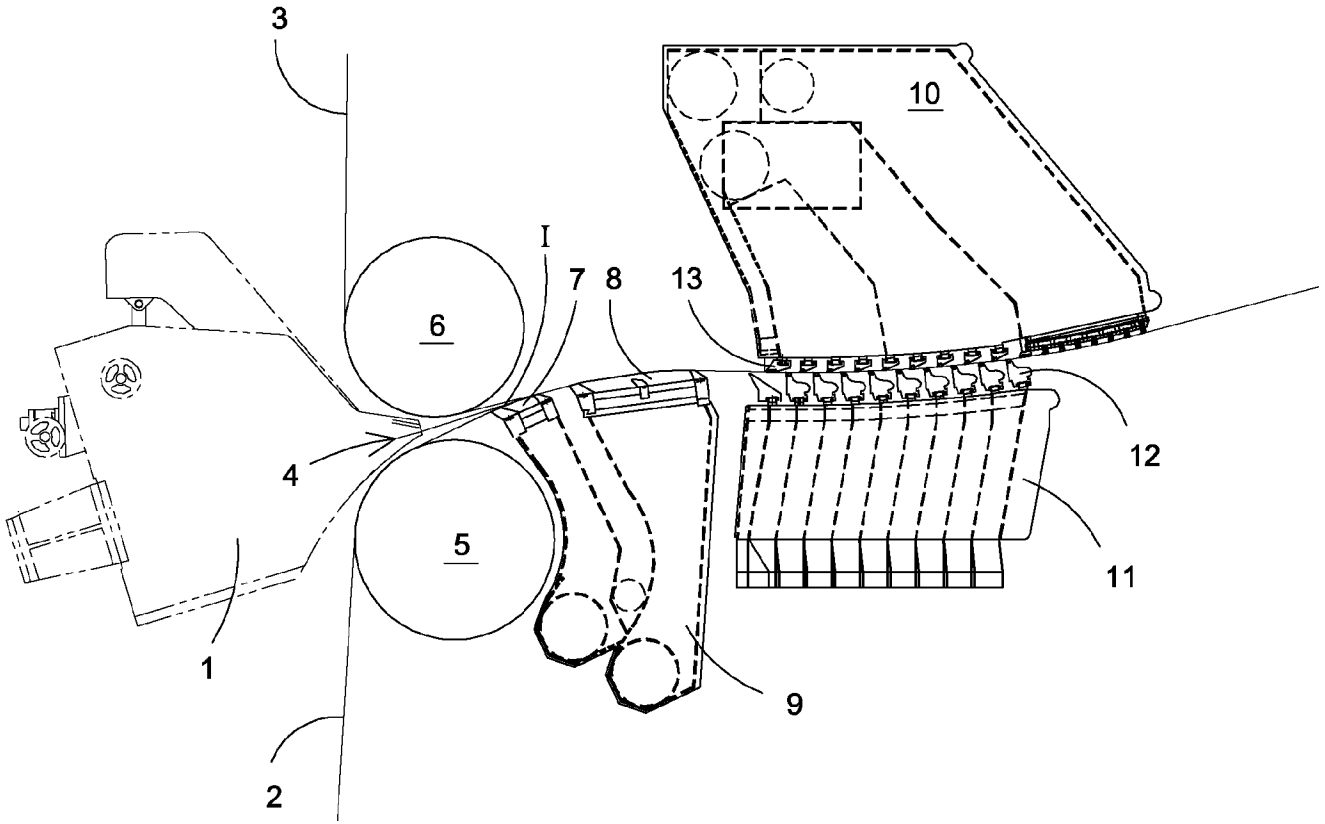
FIG. 2 is an enlarged view of the initial impingement zone shown in FIG. 1.

FIGS. 1 and 2 illustrate a twin fabric forming section including two drainage shoes. The forming section is a gap type former. In this embodiment, the first fabric, which in this case is the conveying fabric 2, wraps over breast roll 5 and is directed onto the paper side surface of drainage shoe 7. Stock jet 4 is ejected from the slice lips of headbox 1 and onto fabric 2 at a point of impingement I (see FIG. 2) over drainage shoe 7. The locus of the point of impingement I and the angle of the stock jet relative thereto will be selected in accordance with papermaking requirements; the angle of impingement is generally very small, generally between 0° and 5°, but this may be varied according to need and as described in U.S. Pat. No. 7,005,040. Alternatively, the stock jet can be directed to land first on the backing fabric 3.

The backing fabric 3, shown in these figures as the second fabric, is guided by forming roll 6 so that it is brought into contact with the stock layer being formed on conveying fabric 2 as it passes over first drainage shoe 7. The backing fabric 3 serves to sandwich the stock layer between it and the conveying fabric 2 so as to minimize any undesirable two-sidedness characteristics in the embryonic sheet. The stock layer commences initial drainage as it passes over first drainage shoe 7 by virtue of the flow through slots or holes (not shown) through the shoe.

A second drainage shoe 8 is located immediately downstream of drainage shoe 7 and is separated from it by a small distance. The distance between the first drainage shoe 7 and the second drainage shoe 8 will be dictated by papermaking requirements, as well as available space and geometry in the forming section, but in most cases in this configuration this distance will be from about 1 to 12 inches (25-300 mm). Drainage shoe 8 will be located relative to drainage shoe 7 such that there is either a wrapped edge between them (i.e. the fabrics bend at the trailing and leading edges of the drainage shoes as they proceed from the downstream edge of drainage shoe 7 to slide over the leading edge of drainage shoe 8), or the two drainage shoes are tangent and the fabrics continue without wrapping from the first drainage shoe 7 to the second drainage shoe 8 (i.e. there is no deflection or bending of the fabrics as they pass from the first to the second drainage shoe). As discussed above, both the gap between the two drainage shoes, and the degree of wrap of the fabrics as they leave the first drainage shoe to pass over the second would be selected in accordance with papermaking conditions.

In this embodiment, the drainage shoes 7 and 8 are both located on drainage box 9. The box 9 may either be suction assisted, or it may rely on gravity to manage the fluid drained into it from the stock. However, preferably box 9 is suction assisted and partitioned to allow for individual vacuum control to each drainage shoe 7 and 8. As the fabrics 2 and 3 including the stock layer sandwiched in between proceed over the drainage shoes 7 and 8, fluid is drained from the stock layer through the flow through slots or holes in the drainage shoes. In addition, the stock layer sandwiched between the fabrics is subjected to a continuous sustained pressure or shear as the fabrics pass in sliding contact over the surfaces of the drainage shoes 7 and 8. The MD surface profile of the drainage shoes will play a significant role in determining the magnitude of the sustained pressure (i.e. the degree of curvature and shape of the curve, whether it is simple or compound, etc). The angle of wrap of the fabrics will play a significant role in the amount of drainage at each drainage shoe, and can be adjustable, for example by pivoting box 9 towards or away from the headbox in a manner such as is described by Wildfong et al. in US 2007/0295468.

Following the drainage shoe 8, the fabrics 2 and 3 together with the stock layer sandwiched in between pass in sliding contact against a series of fixed blades 13 mounted on dewatering box 10. Resiliently mounted blades 12 located on box 11 are spaced so as to press against the fabrics 2 and 3 and stock layer as they pass over blades 13. This arrangement serves to further pulse the stock layer to provide improvements to formation, and to further drain the sheet. As shown in FIG. 1, the fabrics then pass over further downstream suction dewatering boxes 14 and 15 upon which stationary dewatering blades are mounted, and then over suction couch roll 16, which may be provided with one or more suction chambers to further remove water from the sheet. From there, the sheet is transferred to the press section and dryer section (not shown) for further water removal.

Those of skill in the art will realize that the position, size and blade type and spacing on boxes 14 and 15 can be selected in accordance with need, based on the intended end use. The blade configuration and spacing on boxes 10 and 11 can be adjusted in accordance with prevailing papermaking conditions so as to optimize formation and other sheet properties as described for example in co-assigned U.S. Pat. No. 7,524,401 or U.S. Pat. No. 7,524,402 to Wildfong et al.

Figure 3:
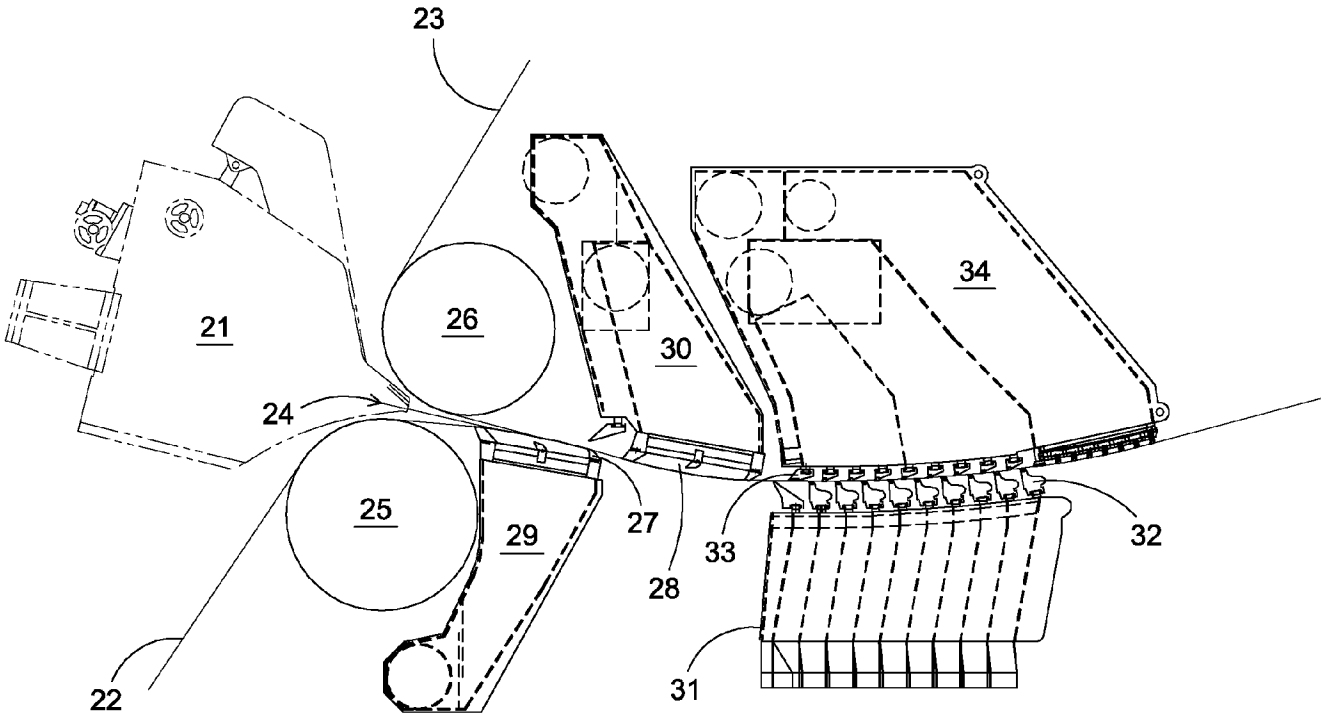
FIG. 3 is an enlarged view of the initial impingement zone of a second embodiment of the invention.

Referring now to FIG. 3, this shows a twin fabric forming section according to an alternate embodiment of the invention in which two drainage shoes 27 and 28 are located sequentially, and in opposing orientation, one being provided to each of fabrics 22 and 23. In this embodiment, the fabrics 22 and 23 sandwich the stock 24 delivered from headbox 21, and pass over first drainage shoe 27 which is adjustable in position so as to modify the angle of wrap of the fabrics 22 and 23 in accordance with need. From the drainage shoe 27, the fabrics together pass over the surface of drainage shoe 28 which is also adjustable so as to vary the angle of wrap of the fabrics. A larger angle of wrap provides greater dewatering which would be appropriate for higher basis weight paper grades. The drainage shoe 28 is pushed against the fabrics so that they wrap both the trailing edge of drainage shoe 27 and the leading edge of drainage shoe 28 to provide a relatively strong and continuously sustained pressure pulse in the stock. Following drainage shoe 28, the fabrics pass over fixed blades 33 mounted on dewatering box 34. Resiliently mounted blades 32 mounted on box 31 are located so as to apply pressure against the fabrics and stock as they pass over blades 33 on box 34. The drainage shoe 27 is located on box 29, while drainage shoe 28 is located on box 30; both boxes 29 and 30 are provided with separately controllable vacuum, allowing for independent control of the vacuum level applied to each of the drainage shoes 27 and 28.

It would also be possible to mount drainage shoe 28 as the lead-in shoe on drainage box 34 and omit box 30 entirely. The drainage shoe 28 would then be located so that the fabrics 22 and 23 together with the stock layer in between wrap over the surface of drainage shoe 28 in a manner similar to that shown in FIG. 3. The drainage box 34 could be mounted so as to be pivotable, and adjustable in position so that the angle of wrap of the fabrics 22 and 23 could be adjusted according to papermaking requirements similarly to e.g. box 29. Further elements downstream of boxes 31 and 34 can be selected according to the operating environment and end use, for example as shown in FIG. 1 following boxes 10 and 11.

Figure 4:
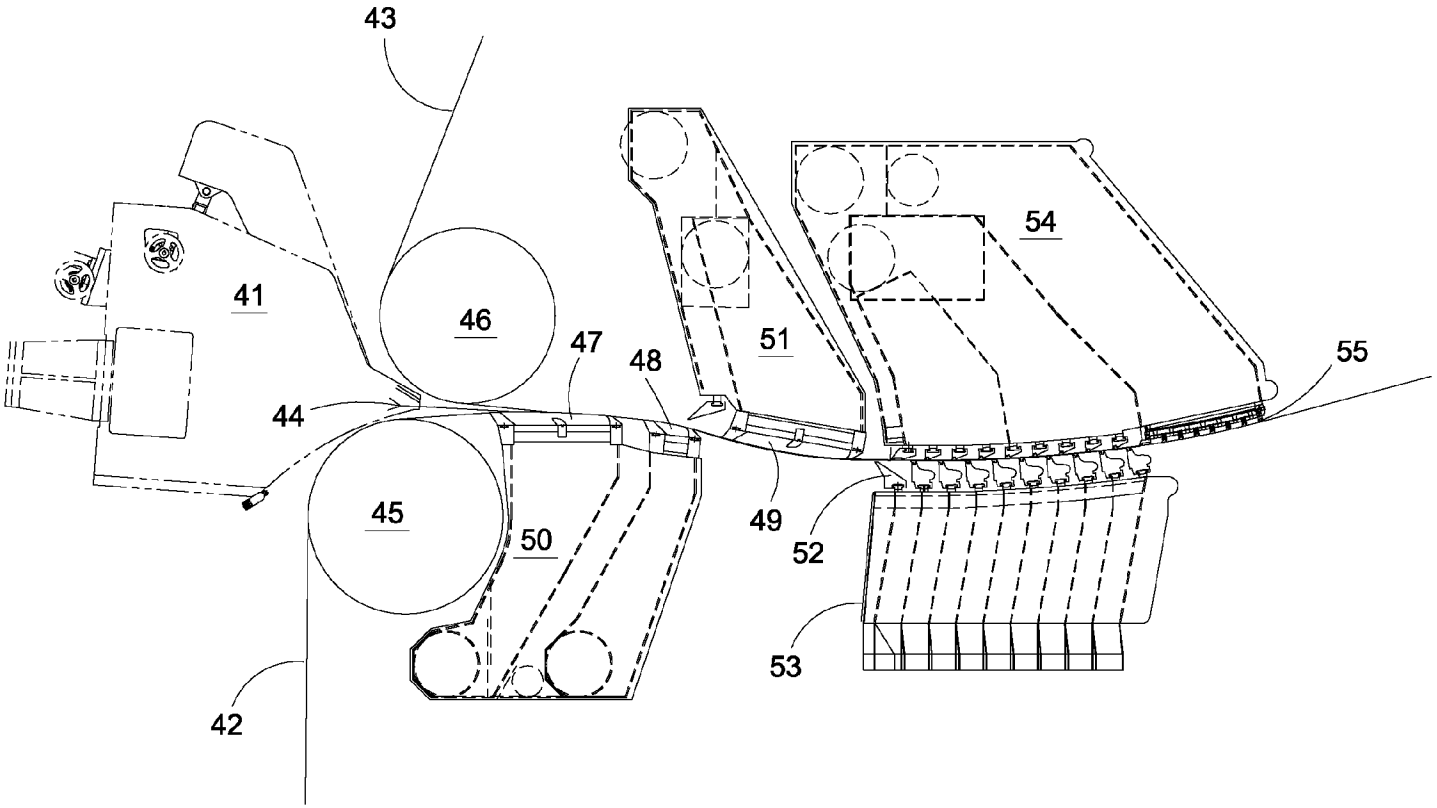
FIG. 4 is an enlarged view of the initial impingement zone of a third embodiment of the invention.

FIG. 4 is a illustration of a forming section according to a further embodiment of the invention and which includes three drainage shoes. In this embodiment, two drainage shoes 47 and 48 are mounted on common dewatering box 50. Box 50 includes two independent drainage areas and vacuums, and can be pivoted or adjusted so as to increase or decrease the angle of wrap of the fabrics 42 and 43 as necessary in accordance with prevailing papermaking conditions. Third drainage shoe 49 is located downstream on suction assisted drainage box 51. Box 51 is adjustable so as to vary the angle of wrap of the fabrics in response to changes in papermaking conditions (e.g. a change in paper grade being manufactured).

Machine direction gaps exist between each of drainage shoes 47, 48 and 49, the gap between drainage shoes 47 and 48 being between 1 and 12 inches (25 to 300 mm), and between drainage shoes 48 and 49 being between 2 and 18 inches (50 to 457 mm), depending on forming section geometry, spatial constraints and other factors. Downstream blades 52 and 55, provided respectively to boxes 53 and 54, correspond to blades 32 provided to box 31 and blades 33 provided to box 34 in FIG. 3.

Figure 5:
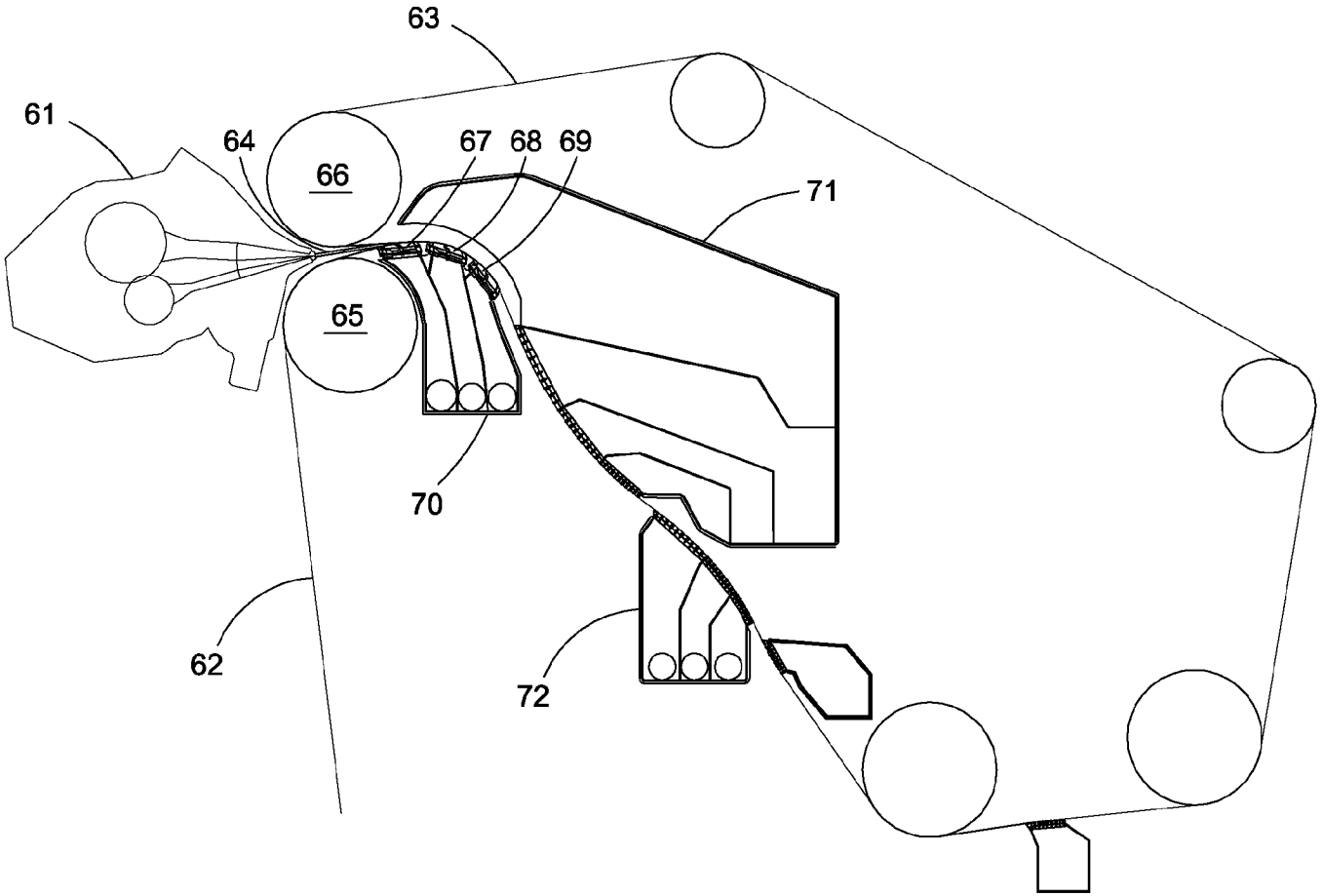
FIG. 5 is a schematic illustration of a forming section according to a further embodiment of the invention.
Figure 6:
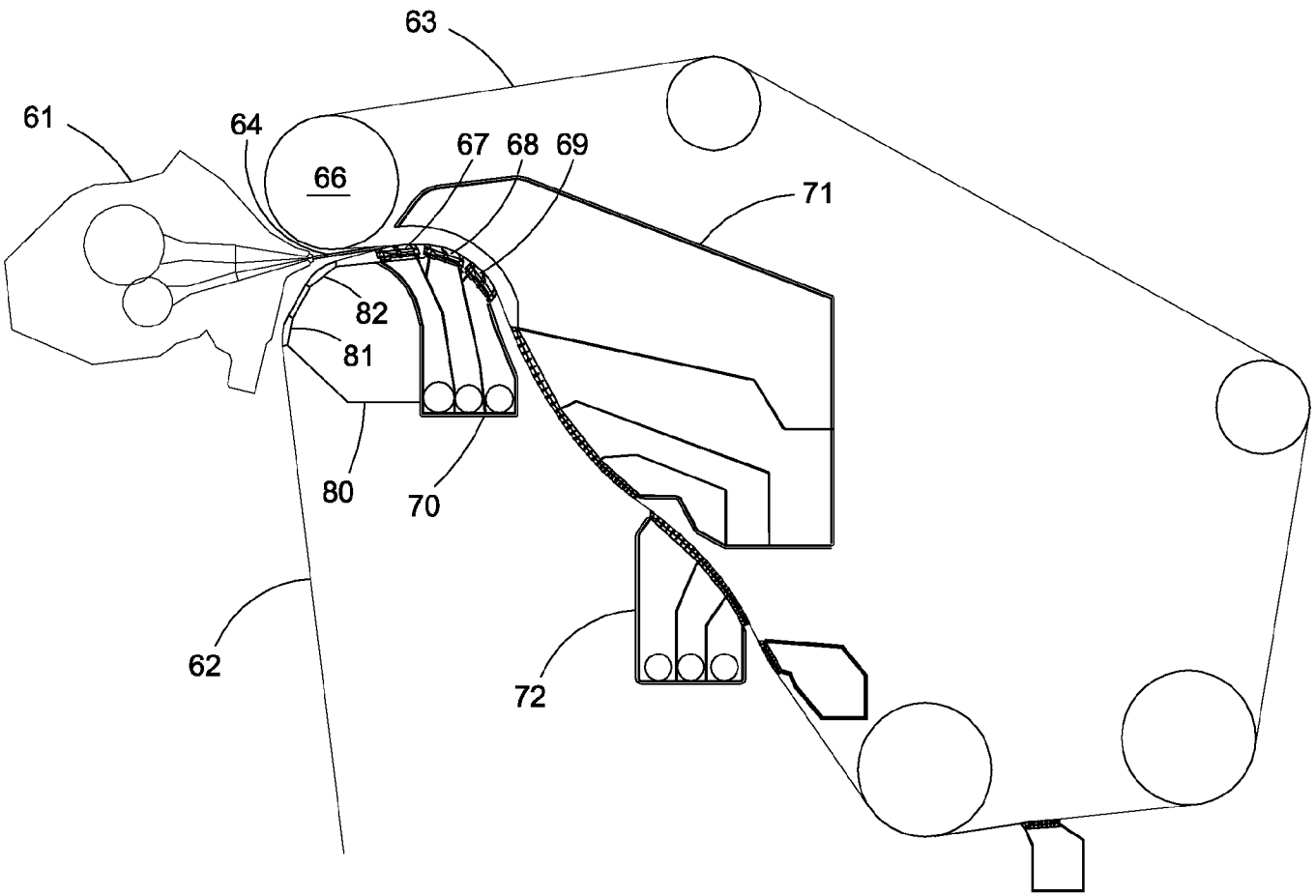
FIG. 6 is a schematic illustration of a forming section according to a further embodiment of the invention.

FIGS. 5 and 6 illustrate further embodiments, as alternate versions to that provided in FIG. 4, each comprising a forming section including three drainage shoes 67, 68, 69, each located in contact with the first fabric 62. In FIG. 5, headbox 61 injects a two-ply stock jet between first fabric 62 and second fabric 63 as they pass around forming roll 66 and breast roll 65 respectively. The fabrics 62 and 63 with stock then pass over the three drainage shoes 67, 68 and 69 in succession mounted on drainage box 70. Stock jet 64 includes two stock feeds from each of the two stock delivery tubes. The angle of wrap of the two fabrics as they pass over the drainage shoes 67, 68 and 69 is approximately 60°, but this can be adjusted depending on papermaking requirements and can be as large as 100°.

FIG. 6 illustrates an embodiment similar to that shown in FIG. 5, in which breast roll 65 is replaced by turning bars 81 and 82 mounted on box 80. This variation reduces the size of the fabric turning apparatus at this point (in wide paper machines, the roll diameter must be increased to provide the necessary rigidity required across the machine width; as the machine becomes wider, roll diameter increases) and allows the distance from the slice lips to the point of impingement to be reduced or at least maintained relative to a narrow machine.

In each of FIGS. 5 and 6, the elements downstream will be selected according to the operating environment and end use, for example to include boxes 71 and 72.

It would also be possible in the arrangements shown in any of FIGS. 1 to 4 to replace either the breast roll (such as 5 in FIG. 1) or the forming roll 6 (FIG. 1) with a set of turning bars similar to those shown as 81 and 82 in FIG. 6. Turning bars are well known in the art having been described for example by Ewald, in U.S. Pat. No. 5,084,138. These turning bars are typically coated with a wear resistant material such as a ceramic so as to resist abrasive wear. Use of turning bars in this location may allow positioning of the headbox closer to the point of impingement for improvements in formation. The major requirement to allow for their use is that sufficient lubrication be provided to prevent heating and degradation of the fabrics.

The invention claimed is:

1. A forming section for a twin fabric papermaking machine, the forming section constructed and arranged to receive a pair of forming fabrics comprising a first fabric and a second fabric, each supported by a plurality of rolls and support elements, the forming section comprising (i) a headbox having a headbox slice, wherein in operation (a) the headbox delivers a jet of stock through the headbox slice onto the first fabric at a point of impingement;

(b) the first fabric passes over a first support element upstream of the point of impingement, and carries the stock as a layer after the point of impingement; and (c) the second fabric passes over and is guided by a second support element into contact with the stock layer proximate the point of impingement and thereafter cooperates with the first fabric to sandwich the stock layer; and (ii) a plurality of drainage shoes, comprising at least (a) a first drainage shoe located to support a selected one of the first and second fabrics in sliding contact;

(b) at least a second drainage shoe downstream of and spaced apart from the first drainage shoe over which a selected one of the forming fabrics passes in sliding contact, wherein (1) each drainage shoe is constructed and arranged to provide continuous contact and support in the machine direction to the respective selected one of the forming fabrics, and has (A) a leading edge and a trailing edge;

(B) a fabric contacting surface extending to the trailing edge and having predetermined machine direction and cross-machine direction profiles and being constructed and arranged to deflect both the first and the second fabrics and the stock therebetween by a selected angle of wrap of between 5° and 50° comprising an angular displacement between the leading edge and the trailing edge of the drainage shoe, said angular displacement being measured by a change in orientation of a line tangent to the fabric contacting surface at the leading edge in relation to a line tangent to the fabric contacting surface at the trailing edge, such that a total of the selected angles of wrap for all of the drainage shoes together is between 10° and 100°; and (C) a machine side surface;

(2) at least one of the drainage shoes is secured to a drainage box and is provided with a plurality of drainage openings which extend from the fabric contacting surface through to the machine side surface of the shoe; and (3) at least one of the drainage shoes is secured to an adjustable drainage box constructed and arranged to be selectively securably adjusted by at least one of translation and pivoting.

2. A forming section according to claim 1, wherein the first drainage shoe is provided to the first fabric.

3. A forming section according to claim 1, wherein the first drainage shoe is provided to the second fabric.

4. A forming section according to claim 1, wherein the fabric contacting surface of each of the plurality of drainage shoes has an open area of between 0% and 70%.

5. A forming section according to claim 4, wherein the fabric contacting surface of at least one of the plurality of drainage shoes has an open area of between 40% and 70%.

6. A forming section according to claim 1, wherein each of the drainage shoes is secured to a drainage box and is provided with a plurality of drainage openings which extend from the fabric contacting surface through to the machine side surface of the shoe, and for each of the drainage shoes, each of the fabric contacting surface profile, the angle of wrap, and the shape and size of the drainage openings are the same.

7. A forming section according to claim 1, wherein for at least one of the drainage shoes, at least one property selected from the fabric contacting surface profile, the angle of wrap, and the shape and size of the drainage openings is different from a corresponding property of at least one other of the drainage shoes.

8. A forming section according to claim 1, wherein the first drainage shoe is an impingement shoe.

9. A forming section according to claim 8, wherein the impingement shoe comprises a plurality of machine direction oriented laminar segments, at least some of which have fabric contacting paper side surfaces and which together contribute to a profile of the paper side surface of the impingement shoe, and are adapted to be releasably secured by a securing means and are urged into a spaced-apart relationship by spacing means to provide machine direction oriented vents through the impingement shoe.

10. A forming section according to claim 9, wherein the plurality of laminar segments comprises at least a plurality of first laminar segments each of which has a fabric contacting paper side surface which contributes to the paper side surface of the impingement shoe over which the forming fabric moves, and a plurality of second laminar segments at least some of which do not include fabric contacting surfaces and are adapted to be located between selected first laminar segments, the first and second laminar segments being adapted to be releasably secured by a securing means and being urged into a spaced-apart relationship by spacing means.

11. A forming section according to claim 1, wherein the second drainage shoe is provided to the second fabric.

12. A forming section according to claim 1, wherein at least two of the drainage shoes are provided in adjacent sequence to the first fabric.

13. A forming section according to claim 12, wherein at least one drainage shoe is provided to the second fabric downstream of the at least two drainage shoes provided to the first fabric.

14. A forming section according to claim 12, wherein each member of at least one pair of adjacent drainage shoes provided to the first fabric is secured to a common drainage box.

15. A forming section according to claim 1, wherein for each pair of adjacent drainage shoes provided to the same fabric, the trailing edge of the first drainage shoe of the pair is spaced apart from the leading edge of the second drainage shoe of the pair by a distance of between one and twelve inches.

16. A forming section according to claim 1, wherein for each pair of consecutive drainage shoes provided to opposing ones of the fabrics, the trailing edge of the first drainage shoe of the pair is spaced apart from the leading edge of the second drainage shoe of the pair by a distance of between two and eighteen inches.

17. A forming section according to claim 1, wherein at least one of the drainage shoes is secured to an adjustable drainage box.

18. A forming section according to claim 17, wherein each drainage shoe is secured to an adjustable drainage box.

19. A forming section according to claim 1, wherein the first support element comprises a breast roll.

20. A forming section according to claim 1, wherein the first support element comprises at least one turning bar.

21. A forming section according to claim 1, wherein the second support element comprises a forming roll.

22. A forming section according to claim 1, wherein the second support element comprises at least one turning bar.

23. A forming section according to claim 1, further comprising, downstream of and spaced apart from the trailing edge of the last drainage shoe, at least one forming shoe comprising a plurality of cross machine direction oriented fabric support elements.

24. A forming section according to claim 23, wherein the at least one forming shoe is provided to the second fabric, and the forming section further comprises at least one counter-blade unit provided to the first fabric substantially opposite to a first of the at least one forming shoe.

25. A forming section according to claim 23, wherein adjacent ones of the plurality of cross machine direction oriented fabric support elements in at least the first of the at least one forming shoe are spaced apart from each other by a decreasing distance in the machine direction.

26. A forming section according to claim 23, wherein adjacent ones of the plurality of cross machine direction oriented fabric support elements in at least the first of the at least one forming shoe have a decreasing width in the machine direction.

27. A forming section according to claim 23, further comprising a couch roll downstream from the trailing edge of the last forming shoe.

28. A forming section according to claim 1, further comprising a couch roll downstream from the trailing edge of the last drainage shoe.

29. A forming section according to claim 28, wherein the couch roll is a suction roll comprising at least one vacuum zone.

30. A forming section according to claim 1, wherein the selected angle of wrap for the first drainage shoe is between 5° and 45°.

31. A forming section according to claim 30, wherein the selected angle of wrap for the first drainage shoe is between 10° and 35°.

32. A forming section according to claim 1, wherein the selected angle of wrap of at least one of the drainage shoes is between 15° and 35°.

33. A forming section according to claim 32, wherein the selected angle of wrap of at least one of the drainage shoes is between 15° and 25°.

34. A forming section according to claim 1, wherein the total of the selected angles of wrap for all of the drainage shoes together is between 30° and 70°.

35. A forming section according to claim 1, wherein the headbox comprises a two-ply headbox.

36. A forming section for a twin fabric papermaking machine, the forming section comprising:

(i) a headbox having a headbox slice;

(ii) a pair of forming fabrics comprising a first fabric and a second fabric and each supported by a plurality of rolls and support elements, wherein (a) the headbox is constructed and arranged to deliver a jet of stock through the headbox slice onto the first fabric at a point of impingement;

(b) the first fabric passes over a first support element upstream of the point of impingement, and carries the stock as a layer after the point of impingement;

(c) the second fabric passes over and is guided by a second support element into contact with the stock layer proximate the point of impingement and thereafter cooperates with the first fabric to sandwich the stock layer; and (iii) a plurality of drainage shoes, comprising at least (a) a first drainage shoe located to support a selected one of the first and second fabrics in sliding contact;

(b) at least a second drainage shoe downstream of and spaced apart from the first drainage shoe over which a selected one of the forming fabrics passes in sliding contact, wherein (1) each drainage shoe is constructed and arranged to provide continuous contact and support in the machine direction to the respective selected one of the forming fabrics, and has (A) a leading edge and a trailing edge;

(B) a fabric contacting surface extending to the trailing edge and having predetermined machine direction and cross-machine direction profiles and being constructed and arranged to deflect both the first and the second fabrics and the stock therebetween by a selected angle of wrap of between 5° and 50° comprising an angular displacement between the leading edge and the trailing edge of the drainage shoe, said angular displacement being measured by a change in orientation of a line tangent to the fabric contacting surface at the leading edge in relation to a line tangent to the fabric contacting surface at the trailing edge, such that a total of the selected angles of wrap for all of the drainage shoes together is between 10° and 100°; and (C) a machine side surface;

(2) at least one of the drainage shoes is secured to a drainage box and is provided with a plurality of drainage openings which extend from the fabric contacting surface through to the machine side surface of the shoe; and (3) at least one of the drainage shoes is secured to an adjustable drainage box constructed and arranged to be selectively securably adjusted by at least one of translation and pivoting.

* * * * *